US005447463A

United States Patent [19]

Schmitz

[11] Patent Number: 5,447,463

[45] Date of Patent: Sep. 5, 1995

[54] APPARATUS FOR MICROFINISHING

[75] Inventor: Heinz G. Schmitz, Wermelskirchen, Germany

[73] Assignee: Supfina Maschinenfabrik Hentzen GmbH & Co. KG, Remscheid, Germany

[21] Appl. No.: 77,078

[22] Filed: Jun. 16, 1993

Related U.S. Application Data

[62] Division of Ser. No. 598,593, Oct. 19, 1990, Pat. No. 5,245,793.

[30] Foreign Application Priority Data

Feb. 23, 1989 [EP] European Pat. Off. ..... 89103118
Sep. 12, 1989 [DE] Germany ..... 39 30 457.4

[51] Int. Cl.[6] ..... B24B 49/16

[52] U.S. Cl. ..... 451/14; 451/10; 451/49; 451/172

[58] Field of Search ..... 51/165.77, 165.8, 67, 51/66, 165.92; 451/9, 10, 14, 11, 173, 172, 26

[56] References Cited

U.S. PATENT DOCUMENTS 4,478,009 10/1984 Rukavina et al. ..... 51/165.8
4,558,537 12/1985 MacLeod et al. ..... 51/66
4,873,792 10/1989 Linke et al. ..... 51/165.77
5,035,087 7/1991 Nishiguchi et al. ..... 51/165.8

FOREIGN PATENT DOCUMENTS 2906892 9/1980 Germany .
3525330 1/1987 Germany .
3533082 3/1987 Germany ..... 51/204
3618274 12/1987 Germany .

*Primary Examiner*—Robert A. Rose
*Attorney, Agent, or Firm*—Dennison, Meserole, Pollack & Scheiner

[57] ABSTRACT

The invention relates to an apparatus for fine-working or microfinishing of workpiece surfaces, particularly rotationally-symmetrically moved workpieces with oscillating or rotating tools such as honing stones or fine polishing stones, which are in-fed against the workpiece. Dependent on a measured parameter proportional to the machining force, the tool infeed is controlled such that a continuous workpiece material remove with constant removal speed is achieved. The reaction force is measured at any point in the flux of force to determine the machining force.

24 Claims, 6 Drawing Sheets

APPARATUS FOR MICROFINISHING

This is a divisional of application Ser. No. 07/598,593, filed Oct. 19, 1990 now U.S. Pat. No. 5,245,793.

FIELD OF THE INVENTION

The invention relates to a method for fine-working or microfinishing of a workpiece surface, particularly applicable to moving workpiece surfaces, wherein material is cut off or abraded by means of a tool moved relatively thereto and having a plurality of geometrically undefined cutting edges, which tool is infed against the workpiece surface with a specific contact pressure.

BACKGROUND OF THE INVENTION

In the short-stroke honing or superfinishing described in DE-OS 35 33 082, the honing stone is applied to the surface which is to be worked of a rotationally symmetrical workpiece with a specific contact pressure. This is said to result in a certain abrasion of the workpiece with simultaneous smoothing. Further it is said that where the contact pressure applied is only slight the workpiece material removal is also relatively slight and essentially only a smoothing of the workpiece surface takes place. Thereafter, the so-called "release effect" ("Ausklinkeffekt") is said to occur, because the smooth surface of the workpiece is no longer capable of tearing out of the stone structure those cutting grains which have become blunted. However, were the pressure to be considerably increased, the honing stone and the workpiece would be forced into continuous contact because a continuous self-priming of the honing stone would occur, however without the desired smoothing being achieved.

Apart from the last-mentioned disadvantage, a high contact pressure can also be disadvantageous for other reasons. Therefore, the present invention relates also to the microfinishing of workpiece surfaces as carried out with so-called superfinish machines or superfinish equipment. This finishing method lies in the category of "short-stroke honing", and is a process to improve the surface quality or the size precision as well as to produce a defined shape improvement of the workpiece. A machining or chipping with an undefined cutting edge is carried out. This surface finishing belongs in the same category as grinding or lapping. In contrast to grinding, in which rotating tools are used to abrade the workpiece surface, or lapping, which uses loose material, the short-stroke honing process has the following characteristics:

An oscillating honing stone is pressed against a moving workpiece surface with a specific force, whereby, through the grinding effect of the honing stone, the workpiece surface is abraded. The roughness of the workpiece diminishes very quickly during the abrasion process. At the same time, however, the surface of the workpiece influences the surface of the honing stone, whereby the honing stone itself erodes. Long-stroke and short-stroke are the two different methods of honing. Long-stroke honing is often simply referred to as "honing", which makes differentiation between the two all the more difficult. Short-stroke honing is also known as "fine honing", "superfinishing" or "microfinishing". In short-stroke honing, the kinematics of the process and the resulting technological abrasion mechanisms between tool and workpiece differ greatly from the characteristics of long-stroke honing. Therefore, the two processes must be clearly separated. Short-stroke honing differs from long-stroke honing first through a much lower oscillation stroke (0.5 mm to 7 mm compared to strokes of 30 mm and more), and secondly through a higher oscillation frequency.

A further difference between the two processes is that surface refinement is the primary goal of short-stroke honing, whereas with long-stroke honing, the greatest possible surface abrasion per unit time plus surface refinement are desired. Due to the greater abrasion per unit time, a greater roughness necessarily results with long-stroke honing than does with short-stroke honing. In contrast to previous state-of-the-art short-stroke honing, long-stroke honing can be used with positive or form-locking connection or friction-type connection. The positive connection method of long-stroke honing allows better form correction over the friction-type connection method. This was not possible with short-stroke honing until now.

While long-stroke honing is almost exclusively used for interior finishing of cylindrical or similar bores, whereby onto the longitudinal stroke in the direction of the bore axis, a rotational movement of the tool is superimposed, short-stroke honing is mostly used for exterior finishing of rotationally symmetrical workpieces, e.g. rollers and axles, rotationally asymmetrical workpieces such as cams and excenter, for surface finishing of flat surfaces such as tracks and straight edges or rulers, and for interior and exterior finishing of ball bearing inner and outer races.

In no application of short-stroke honing, whether centered or centerless, plunge cutting, passing through or sculpture machining or surface finishing, is it yet possible to achieve a reproducible defined modification in the shape of the workpiece, in addition to surface finishing and improved dimensional accuracy. One reason for this is that in all method variations the tool is held resiliently and frictionally guided against the workpiece and is not constrainedly guided in the infeed direction. Another reason is that, under otherwise constant technological parameters, a maximum workpiece material abrasion results, which is only depending on the tool specification and the starting roughness of the workpiece. This phenomenen, known in the art as the "release effect", always appears when a certain minimum roughness has resulted in the finishing process. At exactly this point, the cutting edge of the honing stone has become so smooth that it no longer cuts, and therefore cannot further abrade the workpiece. If a certain smoothness of the workpiece surface is achieved, the abrasion declines sharply to almost zero.

This "release effect" of the honing stone, observed in various research experiments, is traceable to the blunting of the cutting grains, which, due to the smoothness of the workpiece surface, can no longer be broken out of the bond and replaced by new grains which can cut. Additionally, due to the large contact area between the workpiece and the honing stone, the flushing liquid is not able to remove the workpiece chips and honing stone dust from the pores, and so a passive layer forms between the workpiece and the honing stone.

One disadvantage is the question of after how much abrasion the "release effect" occurs. This depends on numerous influence values, especially the starting roughness of the unfinished workpiece. This can vary greatly, even with mass-produced parts (e.g. differences between dressing cycles of a grinding wheel), so that the degree of material abrasion by the honing stone varies. The results are differences in diameter of the superfinished workpieces, which can be greater than the differences occurring in the previous working stages.

The unstable behaviour of the honing stone is especially disadvantageous during plunge-working of cylindrical parts. Here the honing stone swings out over the edge of the workpiece and primes itself here longer than in the middle. Surface lines with declining ends are the result. This effect is especially distinct in parts with recesses or grooves, such as control pistons, in which the required straight surface lines are hardly achievable.

Therefore, it has already been tried to limit the infeed path of the honing stones with an adjustable stop (DE-OS 35 33 082, see also literature cited in this document and discussion of "release effect" and "self-priming"). As has already been shown in practice, such an adjustable stop can, however, prevent neither the release effect nor self-priming, since there is no relation between the occurrence of these phenomena at the finishing location and the adjustment of the stop.

Apart from the above-mentioned DE-A-35 33 082, reference can also be made to applicant's earlier application DE-A-3 618 274 as well as to the state of the art U.S. Pat. No. 4,558,537, which however, do not lead to entirely satisfactory solutions under exacting or all-round requirements.

OBJECTS OF THE INVENTION

The general object of the present invention is to provide a surface working process, in which the hitherto usual multi-stage processes, by which the surfaces to be smoothed have to be subjected to many consecutive surface working steps, can be reduced to a few stages, ever if in mass-production differing initial conditions, i.e. differing surface qualities, exist.

An object of this invention, therefore, is to make available a process for short-stroke honing of moving workpiece surfaces, in which neither a "release effect" nor selfpriming occurs before the finishing tool actually becomes unusable or before the desired surface finish quality has been reached. The desired surface finish does not necessarily need to be the optimal smoothness of the surface. A mirror-like surface is not always required. The object to achieve a certain remaining roughness or a matt finish should also be attainable. Furthermore, the new process should make defined reproducible alterations to the workpiece shape possible.

SUMMARY OF THE INVENTION

This object is according to the invention generally attained through a multi-step process of the initially mentioned kind. During the entire abrasion phase, free spaces will remain between or behind the undefined cutting edges of the tool. Together these form a gap variable in size. The size of the gap between workpiece and tool will be adjusted according to the tool's contact pressure. The adjustment proceeds through continuous measurement of a reaction force which is directly opposed to the tool's normal force. Here, normal force is understood as the force with which the tool is infed or pressed against the workpiece at a right angle.

The adjustment is even more advantageous when made between a maximum and a minimum value which creates a margin or corridor of contact pressure alternating between these limits. To observe these limits, the infeed of the tool will be adjusted, according to the reaction force measurement, towards or away from the workpiece.

The maximum and minimum values, which define the reaction force corridor, are themselves variable and are dependent on the technological and geometrical limiting conditions of each specific case. In this sense, limiting conditions of the workpiece are, for example, the type of material used or its hardness; limiting conditions for the tool are the grain size, the type of bond, the structure or resistance or hardness as well as the abrasive material concentration. Also the kind, viscosity and intensity of the cooling lubricant influence the technological limiting conditions. Furthermore, the erosion characteristics and the temperature of the area being worked should be considered. All these coinciding interactions between a specific workpiece and tool configuration on one machine will be determined and optimized in a test series under further conditions such as workpiece speed, tool oscillation frequency and amplitude.

The results of such test series determine the maximum and minimum values for the contact pressure corridor.

The minimum value is not reached if the machining force is insufficient and the maximum value is exceeded when the free spaces between the tool and the workpiece are filled up and abrasion no longer occurs. In this way a corridor is defined within which, in the next finishing series, the contact pressure automatically varies as a result of the measured reaction force at the area being worked.

The major characteristic of the invention, the measurement of the reaction force, is used to define the corridor. The corridor fixes the empirical value according to the highest and lowest possible values, and thereby the size of the corridor. The corridor should accelerate the series finishing and its determination is based on the empirical values. If in the next series discrepancies from the first series, for example irregularities in the workpiece material, appear, it is always possible to widen the corridor through continuous reaction force measurement.

In contrast to conventional methods, a completely different behaviour is exhibited by the tool, i.e. the honing stone, as long as a defined space between the honing stone and the workpiece is maintained. Instead of ending the abrasion through a more or less distinct "release", the abrasive grain cuts itself free and abrades the workpiece until there is no longer a defined space. This can happen in two ways: either there is no more contact between the honing stone and the workpiece, or the honing stone lies in frictional contact on the workpiece and "releases" at a certain workpiece roughness.

The main characteristic of the new process is the possibility to complete and maintain a continuously defined machining with the help of short-stroke honing as long as a specific honing gap is maintained between the honing stone and the workpiece. With the help of this process, it is possible, for example, to finish workpieces of different diameters to specific dimensions since the honing gap prevents "smearing" of the honing stone's work surface, so that its abrasive grains can cut freely. Thus, irregularities in the contour line which are produced by customary methods through the uneven "releasing" of the honing stone, can not only be avoided, irregularities already present in the workpiece can be corrected with defined honing.

The reaction force exerted by the workpiece is continuously measured during the entire honing operation and this measurement is used in the readjustment of the tool infeed in the finishing station where the measuring point is located. This reaction force represents the cutting force of all engaging cutting edges, as irregular as they may be. In addition to the reaction force, the diameter of the workpiece can also be measured and this additional measurement can be incorporated in the control value for the infeeding or withdrawing of the tool. Continuous measurement of diameter alone for limiting the infeed movement by stops is known from DE-OS 35 33 082.

According to one embodiment of the invention, the tool infeed will be adjusted so that a continuous abrasion is achieved whereby the surface roughness of the workpiece is kept constant during the abrasion. The infeeding movement can be towards, but also away from the workpiece. In this way it is possible to produce a defined surface roughness.

For adjustment of the contact pressure in general or within the corridor, the reaction force between workpiece and tool is measured with a force detector. The measurement result is fed to an evaluation unit which controls the infeed movement. Every known technique for positioning the tool can be used. In the following more detailed example, an electrical spindle drive is described, which is just one of many possibilities. The infeed movement can be generated hydraulically or pneumatically with a twofold biased piston in a cylinder or with any other system for providing movement along a path.

If the continuous measurement of the workpiece diameter is included in the measurement, whether with or without a pre-set contact pressure corridor, the finishing can be interrupted or stopped by lifting the tool from the workpiece after the desired size of the workpiece has been reached.

To achieve a specific pre-determined surface condition, one can advantageously readjust the contact pressure prior to reaching the desired workpiece dimensions, in a modified version of the method. The first step of the finishing process is then concluded. The final finishing follows immediately, with the same or an altered circumference speed of the workpiece, and ends after a pre-determined time.

In this way, the best possible surface finish is achieved, but a specific surface condition can also be reached. Instead of a mirror-like surface, a dull or matt finish is also possible. The surface can also be finished to a certain condition, to allow a lubricating film to adhere to a remaining roughness.

The device for carrying out the process conforms substantially with a normal superfinish station. The invented device includes, however, an adjustable infeed device, which operates normally or vertically to the working plane between workpiece and tool. This allow the tool to move towards and away from the workpiece. The size and direction of this movement is controlled by a measuring device.

This measuring device is located anywhere in the flux of force of the forces necessary to finish the workpiece. A value proportional to the machining force, i.e. the chip-producing or abrasion force (Zerspankraft) is measured. Generally, the value is a length difference in the flux of force within the finishing station due to such elastic distortions, which result from the finishing forces. This value can also be an electrical changing value in the current path of the one or more electrical drives of the device. For example, in this way the change in current consumption of the electrical drive of an infeeding motor, or the electrical drive for rotation of the workpieces, can be measured. Both electrical change values correspond to changes in the machining force. The change value in the electrical drive for the oscillating movements of the tool can also be measured, since this electrical value is also representative of a change in the momentary machining force.

Instead of obtaining measurement results from the electrical components, the length differences in the path of the infeeding movement of the tool, as well as in the bearing of the tool or in the drive of the oscillating movement, are measured and evaluated.

The length difference in the column, or the reverse flux of force of the device can also be included as a quantity measured.

As long as a measuring device to measure the value proportional to the machining force is used, a wire strain gauge, a piezoelectric strain element gauge, an inductive, capacitive or an optical sensor can be installed in the described position.

In practice, a force detector which is installed directly behind the tool in the tool holder is preferred, for example a piezoelectric strain element gauge. At this location a force transfer occurs at a right angle to the working plane. A normal force, proportional to the machining force, is measured.

The workpiece can be allocated either centered or centerless. The current workpiece size can be measured through contact blades or without contact or through inductive or capacitive sensors, optically.

The foregoing features relate to the formation of a gap of varying size by free spaces between and/or behind the cutting edges of the tool, the gap being kept open by measuring the reaction force as a control value and, depending on the result, infeeding the tool relative to the workpiece. In particular, it is provided that the gap—which is defined by the averaged surfaces of the tool on the one hand and of the workpiece on the other hand—is to be adjusted between a maximum and a minimum value, through the fact that a "corridor" (defined by corresponding limiting values) of contact force is observed, in correspondence with the reaction force measurement.

It has now been found that this process, which is intended for short-stroke honing, can also be used in other methods of fine-working or microfinishing, wherein workpiece material is chipped and/or abraded, for example for grinding and polishing of workpieces (particularly with relatively low relative speed of tool and workpiece), even when, as distinct from the usual short-stroke honing, the tool and workpiece surfaces concerned do not continuously completely overlap each other during the work operation, but rather are alternatively partially exposed.

Accordingly, the aforementioned process is according to the invention generally characterized in that the reaction force exerted on the tool by the workpiece as the sum of counter-forces of all normal force components of the contact pressure acting on the cutting edges is measured continuously and the contact pressure is re-adjusted stepwise to a predetermined maximum limiting value, at which optimum material removal takes place. In particular, readjustment always takes place when, due to material removal the contact pressure has sunk to a predetermined minimum limiting value.

The stepwise readjustment of the contact pressure, in particular the swinging of the contact pressure between the two aforementioned limiting values, has proved to be an advantageous controlling method for all kinds of fine-working and microfinishing wherein workpiece material is removed, especially chipped off and/or abraded. There results a linear material removal which, in contrast, for example, to the above-mentioned "release effect" in short-stroke honing, is a prerequisite for controlled and reproducible machining of the workpiece and makes it possible to avoid the equipment-intensive and time-consuming dividing of the fine-working and microfinishing of workpieces into different processing stages.

A prerequisite for the application of the new process is essentially the continuous measurement of the reaction force as it has been disclosed in a number of variants above.

Further details, characteristics and advantages are contained in the following description of the drawings in which a preferred embodiment example of the invention and measured test results are presented.

DETAILED DESCRIPTION

Figure 1:
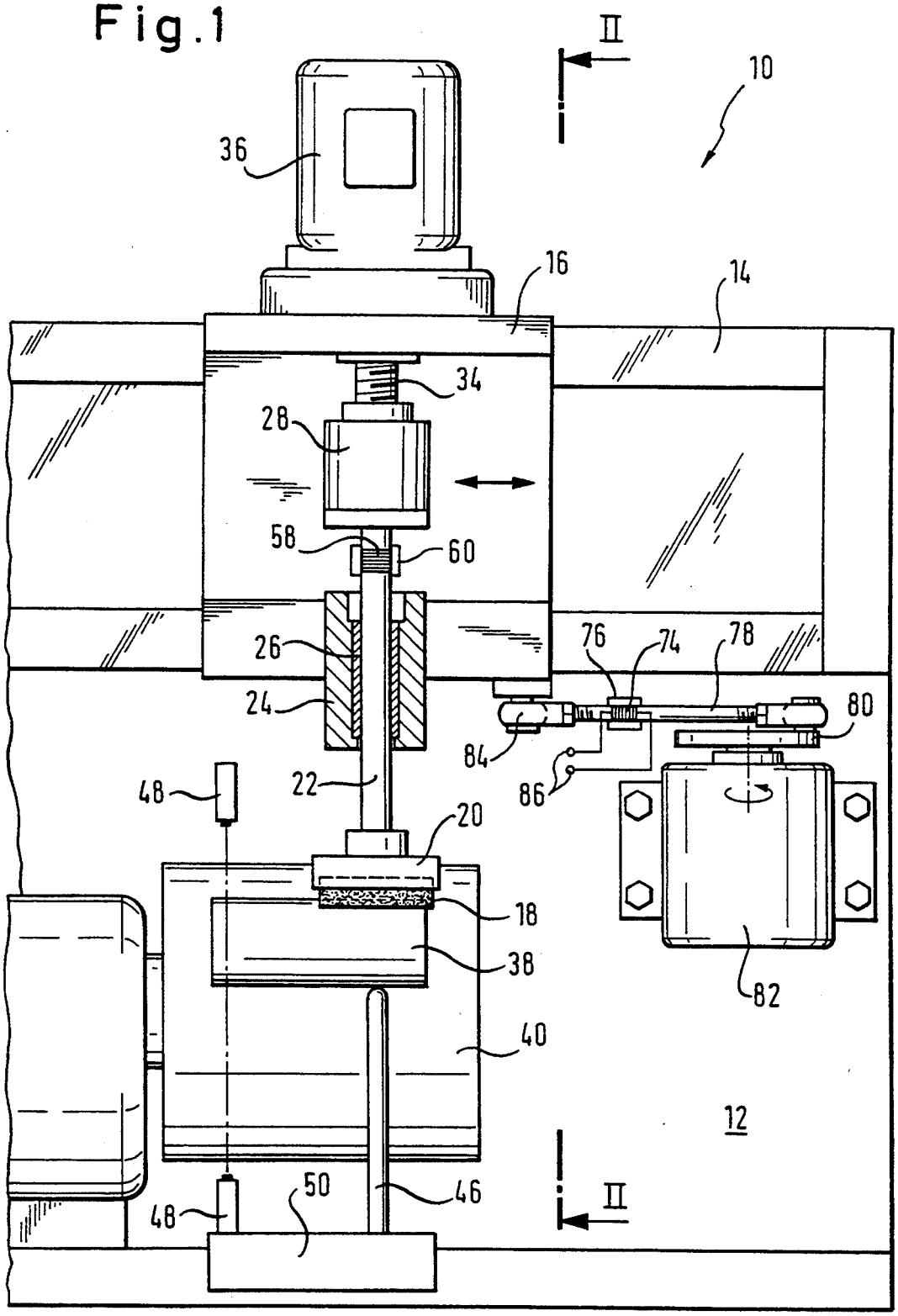
FIG. 1 shows a schematic side view of a preferred embodiment example of a finishing station of the invented finishing device.

A finishing station 10 according to the invention is provided together with other stations, not depicted here, in a superfinish machine of which only the essential parts are visible here. A machine body 12 carries a track 14 on which a sliding carriage 16 travels. The sliding carriage 16 carries a finishing tool with the complementary infeeding mechanism. In the first embodiment, according to FIGS. 1 and 2, a honing stone 18 is provided a stone holder 20 at the lower end of the finishing tool. The stone holder 20 is attached to the lower end of the infeeding rod 22. The infeeding rod 22 is guided by a bearing 26 in a guide cylinder 24 which is attached to the sliding carriage 16. The upper end of the infeeding rod 22 is attached to a screw nut 28 which is moveable up and down in a guide 30 in the sliding carriage 16. The thread 32 of a motor shaft 34 engages with the screw nut 28. The motor shaft is driven by an electrical motor, preferably a stepping motor and is driveable in both directions.

The honing stone 18 is profiled according to the desired surface of the workpiece 38 to be finished. In this example, the workpiece will be finished centerless and therefore is located on two driven rollers 40. The drive, not described further here, moves the rollers 40 in the direction of the arrows 42, whereby the workpiece turns in the direction of arrow 44.

The diameter of the workpiece 38 can be measured with a mechanical detector 46 or through an optical device 48 (shown in dotted lines). In the drawing, only one detector 46 is schematically depicted. In the actual embodiment there are two detectors provided at the sides of the workpiece. The current diameter, as determined by the detector 46 or the optical device 48, is converted by a measuring transformer 50 into an electrical signal, which is fed to an evaluation circuit 54 by a line 52. Another line 56 also leads to the evaluation circuit 54 and transfers a signal received by a force detector 58 as a reaction force of the infeeding movement of the infeeding rod 22. The force detector 58 can, for example, be a piezoelectric element which measures the axial force transferred through the infeeding rod 22 and which force is proportional to the machining force between the honing stone 18 and the workpiece.

The piezoelectrical element of the force detector 58 is guided in a clamp 60, which transfers the non-axial forces. The clamp 60 is located within the force path leading to the optical measuring device 48, in which the displacement of the infeeding rod 22 is also measured, which value is fed as an electrical signal to the evaluation circuit 54 by a line 62.

Figure 2:
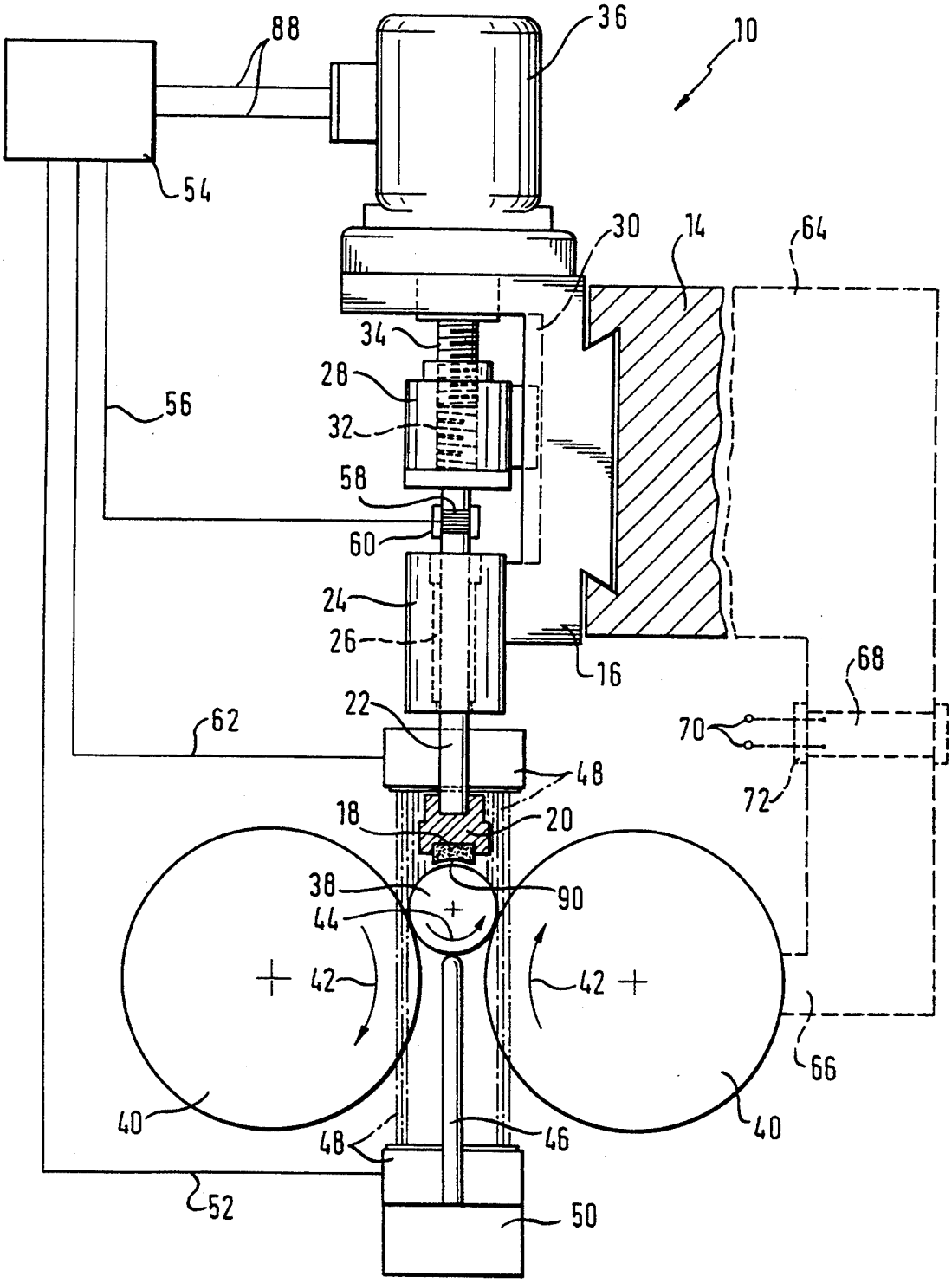
FIG. 2 shows a partial section, along line II—II in FIG. 1

Another embodiment for determining the electrical signal proportional to the machining forces is depicted in FIG. 2 with a dotted line. In this example, the flux of force in a frame 64 of station 10 is measured, which frame is provided between the guide rail 14 and a support beam 66 which carries the drive rollers 40. Here also the longitudinal force guided through the frame 64, which in this case runs parallel to the infeeding direction, is recorded by a force detector 68 inside a clamp 72. The electrical signal measured here is available at the connection 70 and can join the evaluation circuit 54 instead of, or together with, the signal in line 56.

A further variation of force detection is shown in FIG. 1. Here a force detector 74 with clamp 76 lies in the path of a crank rod 78. The crank rod 78 is driven by a motor 82 by means of a crank 80. At the other end of the crank rod 78, the movement is transferred to the sliding carriage 16 via a joint 84. This drive supplies the oscillating longitudinal movement of the honing stone 18 over the workpiece 38. Pneumatic swing units can also be used to produce an oscillating longitudinal movement.

The electrical signal extracted from the force detector 74 is available at connection 86 for forwarding to the evaluation circuit 54 and represents the reaction to the machining force. Therefore, this signal can be used for purposes of the invention together with or instead of the other measured force signals.

In the example depicted, starting, stopping and reverse currents result from the signals sent to the evaluation circuit 54. The currents are sent sequentially through the lines 88 to the stepping motor 36 such that a space 90 between the honing stone 18 and the workpiece 38 is automatically generated as the housing operation is completed.

Figure 3:
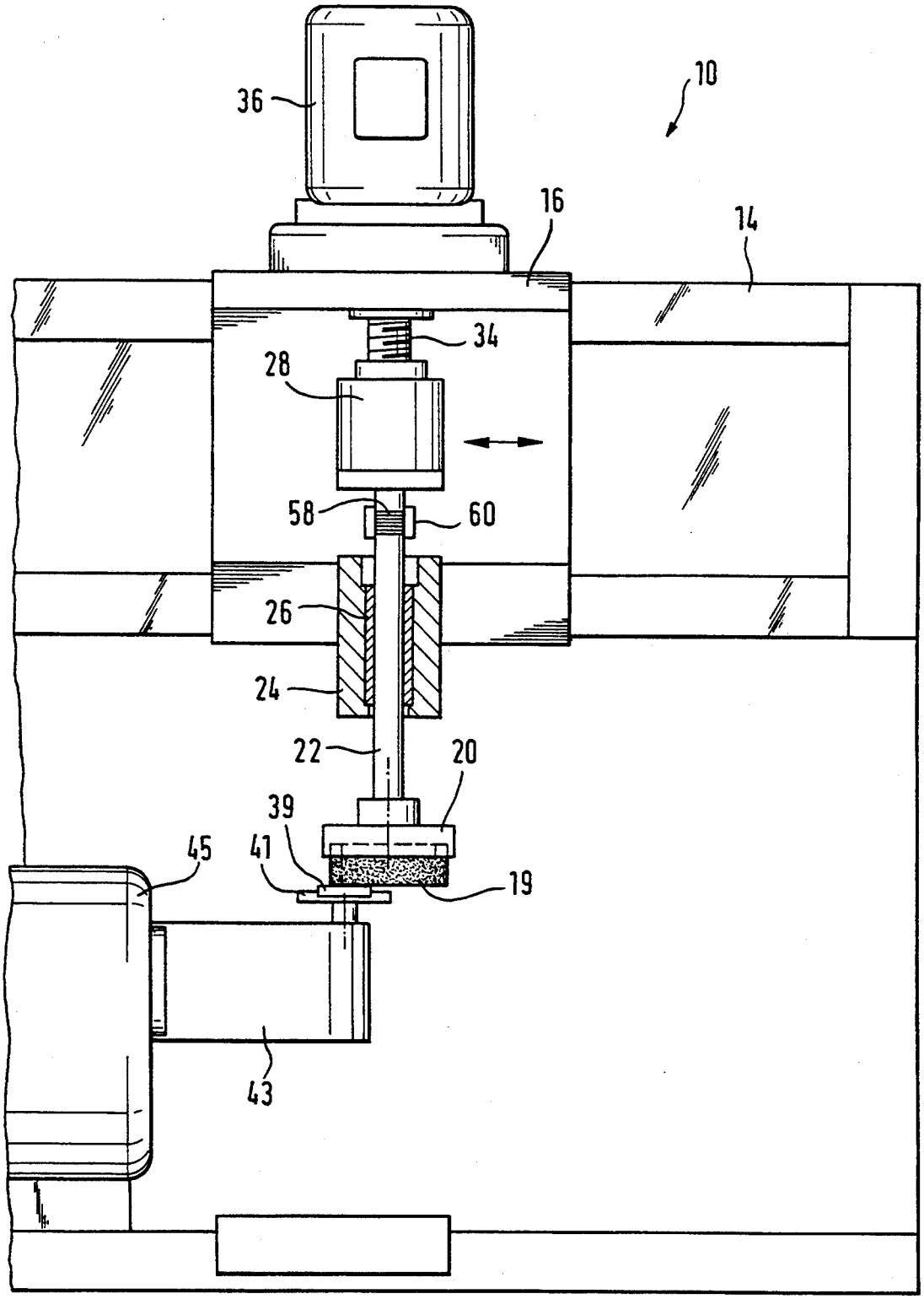
FIG. 3 shows an illustration similar to FIG. 1 of a means for carrying out the process using a fine polishing wheel.

According to FIG. 3, the finishing station 10 of a processing line possibly having further stations carries a track or guiding rail 14 in which a sliding carriage 16 is movably guided. The sliding carriage 16 in turn carries the finishing tool together with the complementary infeeding mechanism. The tool 19, which received in a holder 20, in this case consists of a cup-shaped grinding or polishing disc, whose rotation drive is not illustrated. The infeeding rod 22 is guided by bearings 26 in a guide cylinder 24 which is attached to the carriage 16. The upper end of the infeeding rod 22 is attached to a screw nut 28, which is moveable up and down in a guide in the sliding carriage 16. The thread of a motor shaft 34, which is driven by an electrical motor 36, engages in the screw nut 28. The electric motor 36 is preferably a step motor and is driveable in both directions.

The workpiece 39 is - as schematically illustrated-clamped in a turntable 41, which is set in rotation via a connecting gear 43 by an electrical motor 45. A cup-disc forming the tool 19 has a considerably larger diameter than the workpiece 39; for example, if the cup-disc diameter is 100 mm the diameter of the disc-shaped workpiece 39 would be only 20 mm.

A force detector 58 inserted in the contact pressure path of the infeeding means has a piezoelement guided in a clamp 60. The latter transfers only the non-axial forces. The piezoelement measures only the axial force which is transferred in the infeeding rod 22 and which is proportional to the total force in the corresponding direction and acting between the tool 19 and the workpiece 39.

The electrical output of the force detector 58 is applied to an evaluating unit (not shown) which in the course of a machining process activates the step motor 36 in such a manner that the contact pressure continuously detected as reaction force in the force detector 58 is always readjusted to an empirically predetermined maximum limiting value (at which optimum material removal takes place) when, in the course of the subsequent adjustment stage, the contact pressure has sunk to a minimum limiting value, which has also been empirically predetermined.

Figure 5A:
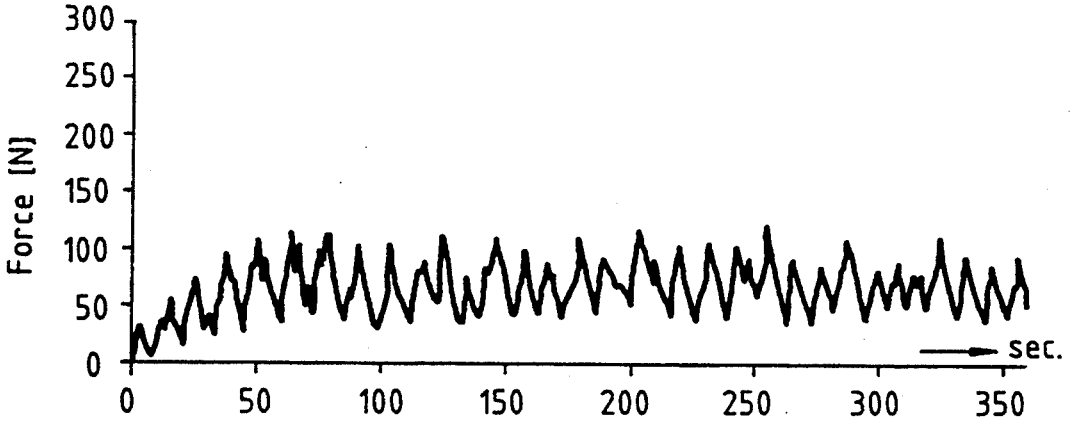
Figure 5B:
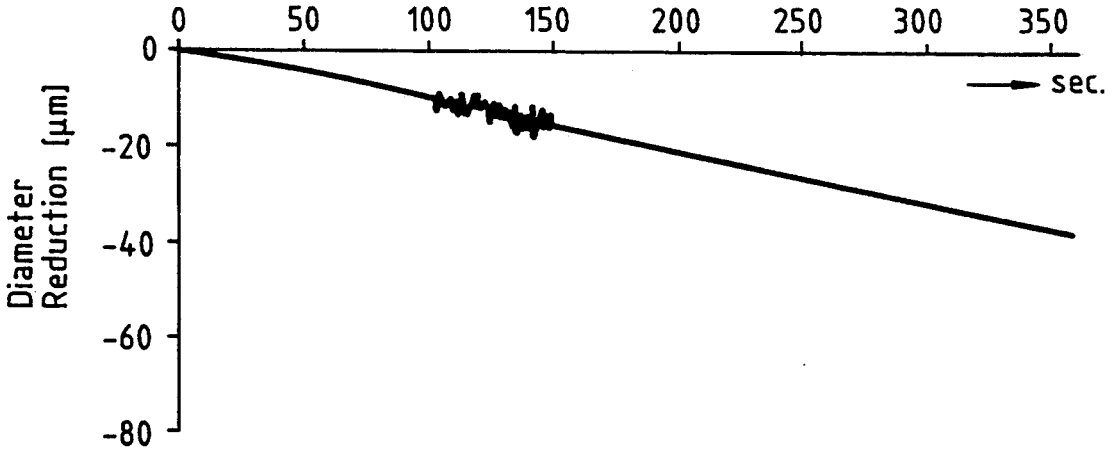
Figure 6A:
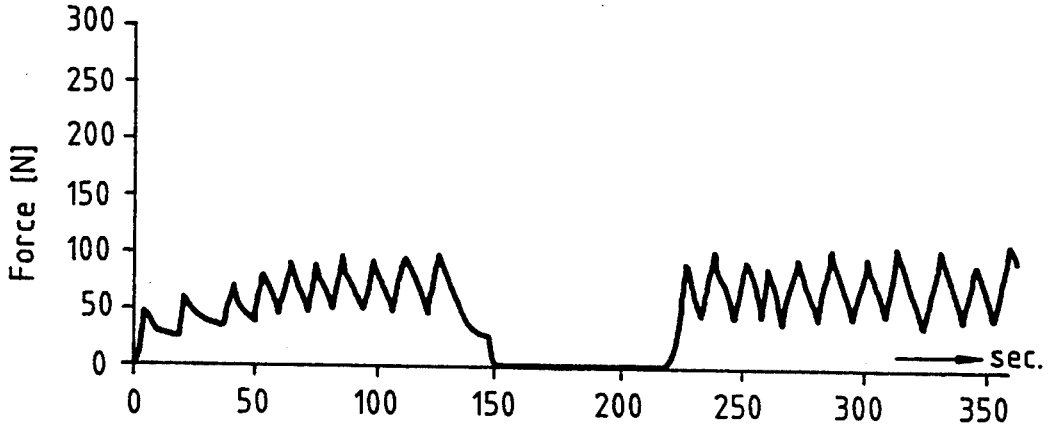
Figure 6B:
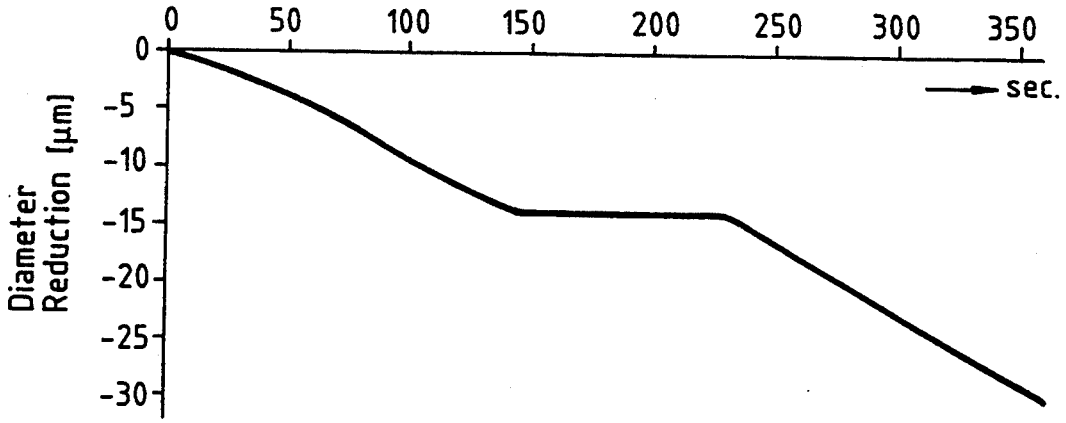

FIGS. 4–6 show diagrams of infeed force developments of the finishing tool in relation to the diameter developments of the workpiece being processed.

The diagrams "a" of FIGS. 4–6 show the time run of the reaction force which has the opposite direction of the tool machining force, as measured in the force detector 58, for example. In this example, according to FIGS. 1 and 2, the tool assembly is moved forward or backward in reaction to the corresponding electrical signals which are sent to the evaluation circuit 54. The time scale has been spread out to make it clearer. In actual practice the adjustments occur much quicker.

The workpiece abrasion process associated with this force run or development, that is, the diameter reduction of the workpiece, is depicted in the diagrams "b" of FIGS. 4–6.

The curves of the diagrams have been simplified to straight lines. The actual course of the curves shows a somewhat uneven run due to the measurement inaccuracies and the surface roughness of the workpiece, as shown in the time frame between 100 and 150 seconds in FIGS. 4*b* and 5*b*.

The principal difference between finishing or working with constant finishing or working force and controlled finishing or working force is now clarified by FIGS. 4–6. The finishing tests corresponding to these diagrams were the same in all technological parameters; they differ only in the tool infeeding method. The technological parameters; such as starting roughness of the workpiece, swing amplitude of the finishing stone, RPM of the workpiece, cooling lubricant used, finishing stone specifications and size, which all have an influence on the abrasion of the workpiece, were kept constant in the finishing tests on which the diagrams are based.

Figure 4A:
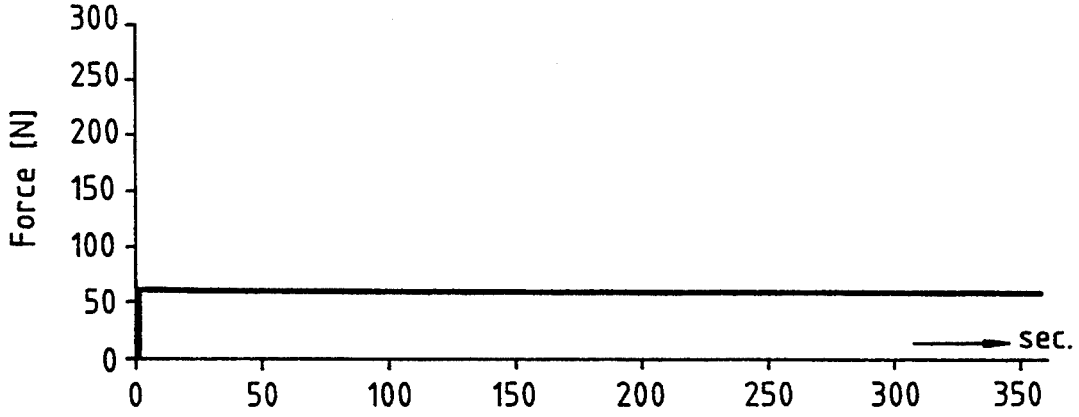
FIG. 4–6 show schematic diagrams of infeed-force developments of the tool with the corresponding time developments of the workpiece abrasion.
Figure 4B:
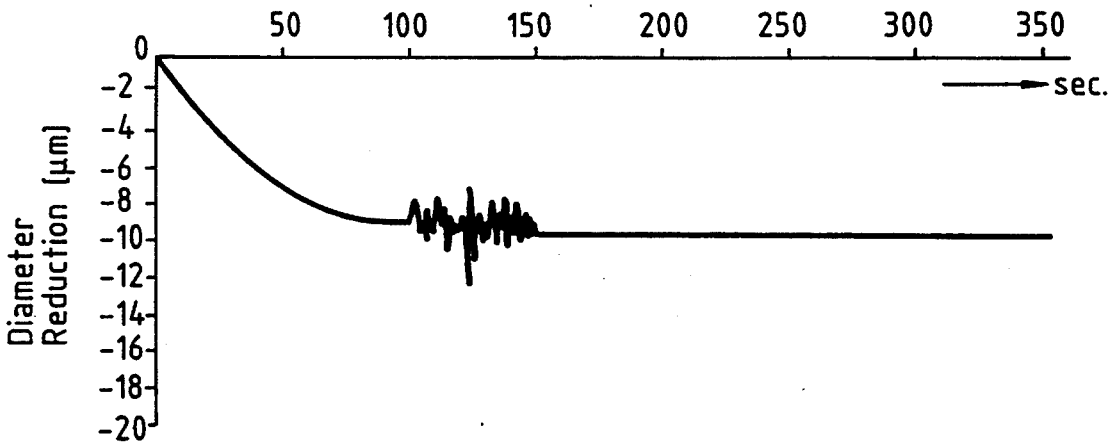

As can be seen in FIG. 4, the tool infeeding force increases at the start of the finishing, at the moment of first contact between workpiece and tool to the pre-set value proportional to the force. During the entire finishing, the reaction force and thereby the tool infeeding force are kept constant through the appropriate control devices (FIG. 4*a*). A discontinuous abrasion occurs on the workpiece, dependent on the set tool infeeding force (FIG. 4*b*). The abrasion increases sharply at the start of the finishing. As the finishing continues, the abrasion rate declines more and more. After a certain period, depending on the technological margin parameters, no more abrasion occurs. Even lifting and again placing the same honing stone 18 on the partially finished workpiece 38 does not bring any further abrasion.

This is typical behaviour of finishing with constant infeeding pressure according to the state-of-the-art. This known process produces an almost constant abrasion with discontinuous abrasion speed, depending on the technological conditions, until a constant workpiece roughness is achieved.

On the other hand, through the process according to the invention, with controlled tool infeeding, a continuous abrasion behaviour can be realized through the defined alteration of the finishing forces, with the correlated, theoretically infinite workpiece material removal resulting therefrom.

The abrasion speed achieved thereby is primarily dependent on the technological conditions, on the infeeding force and the honing stone specifications. The surface roughness of the workpiece depends mostly on the specification of the honing stone used and is constant through the entire machining process. (Exception: at the start of the finishing, as a result of the starting roughness of the workpiece.) The machining process can be interrupted and continued as often as necessary, such that, with the help of this process it is possible to achieve a defined workpiece size through continuous abrasion. In FIGS. 5*a* and 5*b* the force and abrasion runs of a machining session with force controlled tool infeed are depicted. In this test care was taken not to allow the finishing force to exceed a minimum or maximum value through variations in tool infeeding (FIG. 5*a*). The force was kept within an empirically determined corridor to achieve the continuous abrasion (FIG. 5*b*). If finishing is interrupted, it is possible to continue the finishing in the same form at any time with identical finishing parameters. The finishing stone was lifted in the time period of between 150 and 220 seconds and the workpiece diameter measuring device remained active.

At the beginning of this test (FIGS. 6*a, b*), as with the last test (FIGS. 5*a, b*), a continuous abrasion could be reached through controlled tool infeeding.

The abrasion speed in both tests were the same. At 150 seconds after the start in FIGS. 6*a, b*, the finishing stone was lifted from the workpiece. In consequence, the finishing force fell to zero. No further abrasion occurred. The signals of the diameter measuring device confirm this, as they remain constant in the time period in which the finishing stone is not in engagement. The correlated absolute value in this example is ca. 15 m. At 220 seconds after the start, the finishing stone was replaced on the workpiece in the same way as before being lifted. The finishing force increases and is controlled through the infeeding. At the same time abrasion occurs again, in the same degree as before the interruption, confirmed by the same increases in the abrasion curve before and after the interruption.

I claim:

1. Apparatus for microfinishing the surface of a moving workpiece comprising: a frame, tool support means including a tool; means for enabling relative movement between the moving workpiece and the tool; and controllable infeeding device supported by the frame to continuously provide a variable machining force operating in a direction which is normal to the workpiece surface; a measuring device for measuring a parameter proportional to said machining force; and said infeeding device controlled by the measured parameter so as to move the tool toward and away from the workpiece surface to cause said measured parameter to vary between predetermined limits;

wherein the parameter proportional to the machining force is a displacement parameter in the flux of force within the frame, the measuring device for measuring the parameter proportional to the machining force is an optical measuring element, and said workpiece is in the form of a cylinder having an axis and the means for enabling relative movement between workpiece and tool consists of two rollers turning in the same direction, whereby the workpiece is suspended centerlessly and is turned while the tool is moved through a swing movement in the direction of the workpiece axis by means of an excenter drive.

2. Apparatus according to claim 1 further including means for continuously measuring the actual size of said workpiece.

3. Apparatus according to claim 2 wherein the actual size of the workpiece is measured by means of contact blades of a measuring device.

4. Apparatus according to claim 2 wherein the actual size of the workpiece is measured by means of a sensor selected from one of contact-free inductive, capacitive, and optical devices.

5. Apparatus for microfinishing the surface of a moving workpiece comprising: a frame, tool support means including a tool; means for enabling relative movement between the moving workpiece and the tool; a controllable infeeding device supported by the frame to continuously provide a variable machining force operating in a direction which is normal to the workpiece surface; a measuring device for measuring a parameter proportional to said machining force; and said infeeding device controlled by the measured parameter so as to move the tool toward and away from the workpiece surface to cause said measured parameter to vary between predetermined limits; the means enabling relative movement includes an electrical motor, the parameter proportional to the machining force is a changing electrical parameter in the current path of said electrical motor, and the said electrical parameter is detectable in the current path of the motor which forms part of the infeeding device and wherein the relative movement between the workpiece and the tool is in the form of an oscillating movement.

6. Apparatus according to claim 5 wherein the device for measuring said parameter proportional to the machine force forms part of the adjustable infeeding device.

7. Apparatus according to claim 5 wherein said frame includes means for supporting the workpiece and the proportional parameter measuring device forms part of said tool support means.

8. Apparatus according to claim 7 wherein said tool support means comprises a bearing.

9. Apparatus according to claim 5 wherein the device for measuring the parameter proportional to the machining force is a wire strain gauge.

10. Apparatus according to claim 5 wherein the device for measuring the parameter proportional to the machining force is a piezoelectrical element.

11. Apparatus according to claim 5 wherein the measuring device for measuring the parameter proportional to the machining force is an inductive sensor.

12. Apparatus according to claim 5 wherein the measuring device for measuring the parameter proportional to the machining force is a capacitive sensor.

13. Apparatus according to claim 5 wherein the measuring device for measuring the parameter proportional to the machining force is an optical measuring element.

14. Apparatus according to claim 10 wherein said piezoelectric element is placed directly behind the tool in the tool holder to measure the force normal to the finishing surface of the workpiece.

15. Apparatus according to claim 5 wherein the workpiece is turned while held by a chuck.

16. Apparatus according to claim 13 wherein said workpiece is in the form of a cylinder having an axis and the means for enabling relative movement between workpiece and tool consists of two rollers turning in the same direction, whereby the workpiece is suspended centerlessly and is turned while the tool is moved through a swing movement in the direction of the workpiece axis by means of an excenter drive.

17. Microfinishing apparatus comprising:

a machine body, a track carried by the machine body, the track supporting a sliding carriage which in turn supports an infeeding mechanism, said infeeding mechanism including a tool holder; a finishing tool attached to said tool holder;

means for enabling relative movement between a workpiece and the finishing tool;

the infeeding mechanism providing a machining force in a direction normal to a workpiece surface which is to be microfinished;

means for continuously generating a signal proportional to said machining force; and means for adjusting the machining force operating in a normal direction between predetermined limits until the workpiece is microfinished.

18. The apparatus according to claim 17 wherein said relative movement means enables a short stroke oscillating movement of the tool; the workpiece being supported on a turntable.

19. Apparatus according to claim 17 wherein said relative movement means enables a rotating movement of a cylindrical workpiece.

20. The apparatus according to claim 17 wherein the means for generating a signal proportional to the machining force is a measure of the flux of force in the machine body and said flux of force is measured by a force detector which is clamped to the machine body.

21. The apparatus according to claim 17 wherein the infeeding mechanism includes a crank rod, a motor for turning the crank rod and a force detector clamped to the crank rod, said force detector generating the signal proportional to the machining force.

22. The apparatus according to claim 19, said cylindrical workpiece has an axis and the means for enabling relative movement between workpiece and tool consists of two rollers turning in the same direction, whereby the workpiece is supported centerlessly and turned while the tool is moved through a swing movement in the direction of the workpiece axis by means of an excenter drive.

23. Apparatus according to claim 22, further including means for generating a signal proportional to the actual diameter of said cylindrical workpiece.

24. Apparatus according to claim 22 wherein said means for generating a signal is a contact free, optical sensor.

* * * * *